United States Patent [19]

Wesner

[11] 4,055,135

[45] Oct. 25, 1977

[54] RUDDER ERROR DETECTOR

[75] Inventor: Charles R. Wesner, Crozet, Va.

[73] Assignee: Sperry Rand Corporation, New York, N.Y.

[21] Appl. No.: 692,814

[22] Filed: June 4, 1976

[51] Int. Cl.[2] ..... B63H 25/36

[52] U.S. Cl. ..... 114/144 E; 244/194; 318/565; 318/588; 340/30

[58] Field of Search ..... 35/10, 2; 73/178 R; 114/144 E; 235/150.1, 150.2, 151.1, 184, 185; 244/194, 195; 324/73 R, 73 AT; 318/565, 563, 586, 588; 340/30, 410

[56] References Cited

U.S. PATENT DOCUMENTS

| | | | |
|---|---|---|---|
| 3,145,330 | 8/1964 | Hecht | 318/565 X |
| 3,379,951 | 4/1968 | Franchi et al. | 244/194 X |
| 3,454,851 | 7/1969 | Kirchhein | 318/565 |
| 3,571,684 | 3/1971 | Bech | 114/144 E UX |

*Primary Examiner*—Stephen G. Kunin

*Attorney, Agent, or Firm*—Howard P. Terry; Joseph M. Roehl

[57] ABSTRACT

Apparatus for detecting malfunctions in rudder-type steering systems utilizes electrical order and rudder angle signals. The rudder-order signal is applied to a closed-loop simulator that includes integrating apparatus adjusted to provide a time-variant simulated rudder angle signal which varies in the same manner that the actual rudder angle signal would vary in the absence of a malfunction when exposed to the same rudder error signal. The simulated and actual rudder angle signals are compared in a summing amplifier whose output is applied to a thresholding circuit which actuates an alarm whenever the instantaneous values of the simulated and actual rudder angle signals differ by more than a predetermined amount.

4 Claims, 1 Drawing Figure

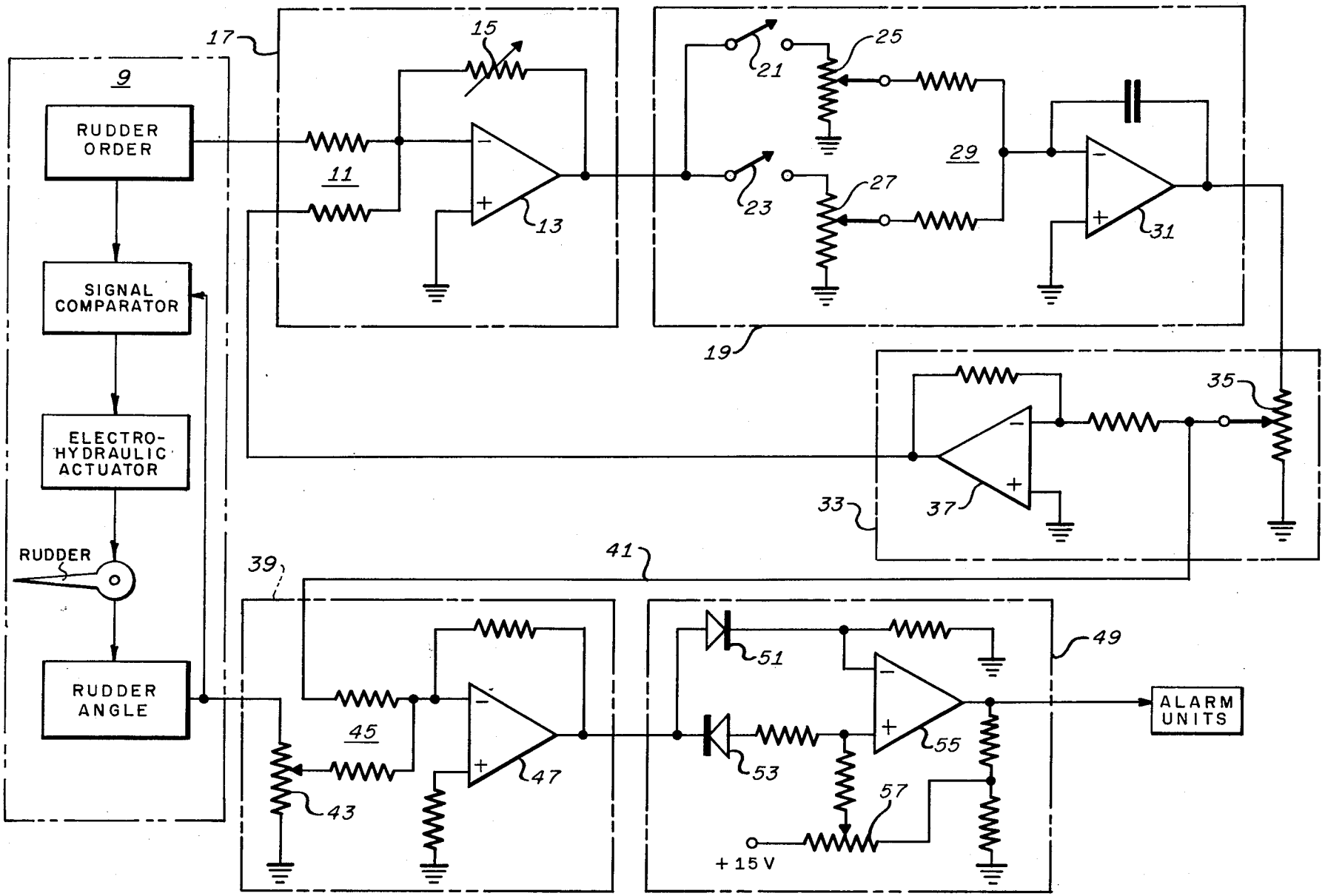
ALARM UNITS
RUDDER ORDER
SIGNAL COMPARATOR
ELECTRO-HYDRAULIC ACTUATOR
RUDDER
RUDDER ANGLE
+ 15 V
9
11
13
15
17
19
21
23
25
27
29
31
33
35
37
39
41
43
45
47
49
51
53
55
57

RUDDER ERROR DETECTOR

BACKGROUND OF THE INVENTION

1. Field of the Invention

The invention relates to alarms and more specifically to alarms for warning an operator of malfunctions in craft guidance systems employing variable-angle control surfaces.

2. Description of the Prior Art

Marine vessels and aircraft frequently employ complex mechanisms to actuate control surfaces such as rudders, elevators, or ailerons.

Marine vessels, for example, frequently employ electrohydraulic systems to actuate the rudder in response to order signals generated by positioning of the helm. Helm angle indicators and rudder angle indicators are often provided on the bridge so as to enable the pilot to compare these values, but such indicators are not conducive to constant surveillance or early warning in case of malfunction. Furthermore, because of the inevitable lag between helm positioning and rudder response, it is difficult to determine when such lag is approaching an unacceptable value. During critical maneuvers, when the occurrence of a malfunction would be the most dangerous, manual observation of the two indicators would be least likely.

SUMMARY OF THE INVENTION

Order signals indicative of the position of a controller element in a craft guidance system are sampled and applied to an analog computer which develops a simulated signal representative of the expected response of the control surface to that order signal. The simulated signal is compared with a signal representative of the acutal control surface response. An alarm is actuated if the instantaneous values of the simulated and actual signals differ by more than a predetermined amount.

BRIEF DESCRIPTION OF THE DRAWING

The single drawing illustrates a circuit employing the principles of the invention.

DESCRIPTION OF THE PREFERRED EMBODIMENT

The accompanying FIGURE illustrates an embodiment of the invention, particularly adapted for use with a follow-up steering system a for a marine vessel wherein rudder orders are generated by either a manual or automatic helm unit and the control surface is a rudder actuated by an electro-hydraulic mechanism.

In manual helm systems, electrical rudder orders are developed by a synchro or potentiometer mechanically actuated by the helm. In automatic helm systems, electrical signals may be developed directly by the automatic unit. In both types of system a second electrical signal indicative of the rudder angle is compared with the order signal and the difference, or error signal, is used to actuate the rudder mechanism.

The circuit depicted in the accompanying FIGURE is particularly adapted for use with a system in which a synchro is used to detect rudder angle. The synchro output is demodulated and applied to the rudder angle input. A d.c. order signal indicative of the helm condition is applied to the rudder order input terminal.

Referring now to the FIGURE, rudder order signals are applied to a summing network 11 forming the input circuit for a differential amplifier 13 having an adjustable feedback loop 15. An inverted simulated rudder angle signal is also applied to the summing network 11 so that the amplifier 13 produces an output signal indicative of the difference between the rudder order and simulated rudder angle signals, as will be explained.

The amplifier 13 and its associated networks constitute a circuit 17 which provides an electrical analog of the rudder servo. The output signal from the simulator 17 constitutes a simulated rudder angle error signal. The variable impedance in the feedback loop 15 is used to calibrate the circuit so that it produces a maximum output representative of the maximum pump flow rate. Typically, this output may be in the order of 10 volts for a five degree rudder error.

The output of the rudder servo simulator 17 is applied to a rudder machinery simulator circuit 19.

As depicted in the FIGURE, the rudder machinery simulator is adapted for a typical system aboard larger vessels wherein main and auxiliary pumping systems are available. In some instances, the second pump may be merely a redundant unit available for use in case the main pumping system fails. In other instances, both pumps may be used simultaneously to obtain faster rudder action when desired.

Referring again to the FIGURE, the output signal from the rudder servo simulator 17 is applied to a pair of on-off switches 21 and 23 which are opened or closed in accordance with the operating conditions of the main and auxiliary pumps respectively.

The output signals from the switches 21 and 23 are applied to pump rate calibrator potentiometers 25 and 27 whose output signals are applied through a summing network 29 to an integrating amplifier 31.

The integrating amplifier simulates the positioning rams in the actual steering system whereas the two potentiometers simulate the two pumps as has been indicated. The potentiometers are adjusted to match the rate of change of the output signal of the simulator 19 to the rate of change of the actual rudder signal derived from the rudder itself.

It will be appreciated that a rapid change in helm position cannot be immediately accommodated by the rudder and its driving system in that a finite time is required to move the mechanical components. However, by calibrating the integrating amplifier and the associated circuits, an electrical signal can be derived which constitutes an electrical analog of the rudder motion to a close approximation.

The output signal from the rudder machinery simulator 19 is applied to a scaling and inverting circuit 33 containing a scaling potentiometer 35 which is adjusted to match the magnitude of the signal from the integrating amplifier 31 to that of the rudder order signal applied to the amplifier 13, and an inverting amplifier 37 which inverts the signal from the amplifier 31 so as to provide the proper phase relationship and thus "close the loop".

The output signal from the scaling potentiometer 35 constitutes a simulated rudder angle signal which is the electrical analog of the rudder motion that can be expected when all electrical circuits and mechanical systems in the steering system and rudder error detector are operating properly. Thus the rudder servo simulator 17, the rudder machinery simulator 19, and the scaling and inverting circuit 33 function as an analog computer which provides a simulated signal closely analogous to the theoretical motion of the rudder in response to a given rudder order signal.

The simulated rudder angle signal from the scaling potentiometer 35 is applied to a comparison circuit 39 through a lead 41.

The actual rudder angle signal is also applied to the comparison circuit 39 through a scaling potentiometer 43. The actual and simulated rudder angle signals are both applied to a summing network 45. These signals are phased so that their difference appears at the input of a comparison amplifier 47.

The output of the comparison circuit 39 is applied to an absolute threshold circuit 49 in which a pair of reverse-biased diodes 51 and 53 couple difference signals of either polarity to a calibrated reference trigger circuit 55. Typically, the circuit 55 may be a conventional Schmitt trigger whose threshold value is adjusted by an alarm calibrator potentiometer 57 so as to provide an output signal to alarm units whenever the instantaneous values of the simulated rudder angle and actual rudder angle signals differs by more than a predetermined amount.

As has been indicated previously, the circuit has been described with reference to a particular marine application as a matter of convenience. Nevertheless, it will be appreciated that the principles of the invention may be applied with straightforward circuit modifications to other marine steering systems or to aircraft flight control systems.

In aircraft systems, the manual controller means would ordinarily be a control stick, control wheel, pedals or the like, rather than a helm unit; the variable angle control surfaces may be elevators or ailerons as well as a rudder means.

While the invention has been described in its preferred embodiment, it is to be understood that the words which have been used are words of description rather than limitation and that changes may be made within the purview of the appended claims without departing from the true scope and spirit of the invention in its broader aspects.

I claim:

1. Apparatus for detecting a malfunction in a ship's hydraulic steering system employing a plurality of pumps, said apparatus including means to provide rudder order and actual rudder angle signals indicative of the instantaneous position of the helm and rudder, respectively, simulator means for providing a simulated rudder angle signal indicative of the expected response of the rudder to an order signal, said simulator means including an adjustable integrating means for providing a time delay approximating that experienced in the mechanical components of the ship's steering system and a separate potentiometer corresponding to each of the pumps for matching the integrator to each pump individually, means for comparing the simulated and and actual rudder angle signals, and means for actuating an alarm whenever the difference between the instantaneous values of the simulated and actual rudder signals exceeds a given threshold.

2. The alarm apparatus of claim 1 further characterized in that said simulator means is a closed-loop circuit containing an input difference amplifier coupled to receive rudder order signals and simulated rudder angle signals from said integrating means, the output of said difference amplifier being coupled to said integrating means through said potentiometer means.

3. The alarm apparatus of claim 2 wherein the comparison means includes a summing network coupled to receive the simulated and actual rudder angle signals and to couple the resulting difference signal to a comparison amplifier.

4. The alarm apparatus of claim 3 wherein the means for actuating an alarm includes a trigger means arranged to provide an alarm signal whenever the output of said comparison amplifier exceeds a predetermined threshold.

* * * * *